United States Patent [19]

Nakano et al.

[11] 4,308,838

[45] Jan. 5, 1982

[54] ACCELERATION SIGNAL DETECTOR

[75] Inventors: Jiro Nakano, Okazaki; Hironobu Ono, Toyota; Hideo Miyagi, Okazaki, all of Japan

[73] Assignee: Toyota Jidosha Kogyo Kabushiki Kaisha, Toyota, Japan

[21] Appl. No.: 63,397

[22] Filed: Aug. 3, 1979

[30] Foreign Application Priority Data

Aug. 30, 1978 [JP] Japan ..... 53-105819

[51] Int. Cl.[3] ..... F02B 3/00; F02M 51/00

[52] U.S. Cl. ..... 123/492; 123/493; 123/494

[58] Field of Search ..... 123/32 EH, 32 EL, 32 EJ, 123/32 EA, 492, 493, 494

[56] References Cited

U.S. PATENT DOCUMENTS

| | | | |
|---|---|---|---|
| 3,335,708 | 8/1967 | Beddoes et al. | 123/492 |
| 3,673,989 | 7/1972 | Aono et al. | 123/492 |
| 3,750,632 | 8/1973 | Zechnall | 123/32 EA |
| 3,759,231 | 9/1973 | Endo | 123/32 EH |
| 3,837,321 | 9/1974 | Sauer | 123/32 EJ |
| 3,858,561 | 6/1975 | Aono | 123/492 |
| 3,898,963 | 8/1975 | Iwata et al. | 123/32 EH |
| 3,926,153 | 12/1975 | Reddy | 123/32EL |
| 4,022,170 | 5/1977 | Crall et al. | 123/492 |
| 4,121,545 | 10/1978 | Mizote | 123/32 EJ |
| 4,126,107 | 11/1978 | Harada et al. | 123/32 EH |
| 4,127,086 | 11/1978 | Harada et al. | 123/32 EL |
| 4,159,697 | 7/1979 | Sweet | 123/492 |

FOREIGN PATENT DOCUMENTS

| | | | |
|---|---|---|---|
| 2550637 | 5/1976 | Fed. Rep. of Germany | 123/32 EH |

*Primary Examiner*—Raymond A. Nelli

*Attorney, Agent, or Firm*—Cushman, Darby & Cushman

[57] ABSTRACT

An acceleration signal detector is provided for detecting an acceleration condition of an engine based on the open-and-close operation of a throttle valve. Switching arrangements associated with the throttle valve are provided for detecting the fully closed condition of the throttle valve and for detecting a partially closed condition of the throttle valve. Signal processing apparatus receives output signals from the switching arrangements, and a change in the output of the means for detecting a partially closed condition subsequent to a change in the output of the means for detecting the fully closed condition is indicative of acceleration. This arrangement eliminates erroneous signals that might otherwise be caused by chattering of switch contacts.

2 Claims, 3 Drawing Figures

ACCELERATION SIGNAL DETECTOR

Japanese patent application No. 53-105819, as to which priority is claimed, is hereby incorporated by reference.

FIELD OF THE INVENTION

The present invention relates to a detector for detecting the accelerating condition of an engine, and more particularly to improvements in an acceleration signal detector for detecting an acceleration signal of the engine based on the open-and-close action of a throttle valve, which is suitable for use in an electronically controlled fuel injection system.

BACKGROUND OF THE INVENTION

In general, in an engine provided with an electronically controlled fuel injection system, in order to prevent the retardation in fuel supply in the accelerating condition of the engine, an acceleration signal detector is provided on a throttle valve. When the accelerating condition of the engine is detected by said acceleration signal detector, the fuel injection rate is increased in advance of the increase in the flow rate of intake air, so that the harmful components in the exhaust gas in the accelerating condition can be decreased and the operating performance can be improved.

The conventional acceleration signal detector used in such an electronically controlled fuel injection system has been constructed such that a switch for detecting the fully closed condition of the throttle valve is provided on the throttle valve. Such switch has been a mechanical switch adapted to be closed when the throttle valve is fully closed, whereby a reverse in the output of the switch for detecting the fully closed condition of the throttle valve from "ON" to "OFF" is detected as an acceleration, thereby effecting increased fuel injection rate, accelerated fuel injection and the like. However, when the above-described switch for detecting only the fully closed condition of the throttle valve is used, a problem is encountered in that the fuel injection system malfunctions due to chattering of the switch at the time of its operation. Particularly, in the case where a dashpot is one of the emission control parts provided in the throttle valve system, the transfer from the opening side to the closing side of the throttle valve is performed very slowly, with the result that the chattering of the switch for detecting the fully closed condition of the throttle valve occurs for a long period of time. Accordingly, this results in an increased fuel flow rate, accelerated fuel injection and the like while the throttle valve is being closed, which are actions contrary to the intended purposes.

In order to obviate the above-described disadvantages, a delay circuit having a comparatively long signal delay time of about 500 milliseconds is provided in a signal processing circuit of the switch for detecting the fully closed condition of the throttle valve. However, the provision of such a signal delay circuit presents a problem in that the delay in response during acceleration becomes large.

SUMMARY OF THE INVENTION

The present invention contemplates obviating the aforesaid disadvantages of the prior art and has as its object the provision of an acceleration signal detector not subject to the effects of chattering and the like and having small retardation in response during acceleration.

According to the present invention, in an acceleration signal detector for detecting an acceleration signal of an engine based on the open-and-close action of the throttle valve, the detector comprises first means for detecting the fully closed condition of the throttle to send out an output, second means for detecting the half closed condition of the throttle valve to send out an output, and signal processing means for detecting an acceleration from a change in the output of the second means subsequent to a change in output of the first means, thereby achieving the aforesaid object.

In addition, the first means is adapted to detect a range from the mechanically fully closed condition of the throttle shaft to the position of the throttle shaft after it is rotated for several degrees.

Furthermore, the second means is adapted to detect several degrees of the half closed condition from the fully closed condition of the throttle valve.

Still furthermore, the first means and second means comprise sector-like fixed contacts which are disposed around the throttle shaft of the throttle valve and brought into contact with the movable contact which is rotatable with the throttle shaft.

Furthermore, the signal processing means is formed of a flip-flop circuit using two NAND gates.

DETAILED DESCRIPTION OF THE INVENTION

Figure 1:
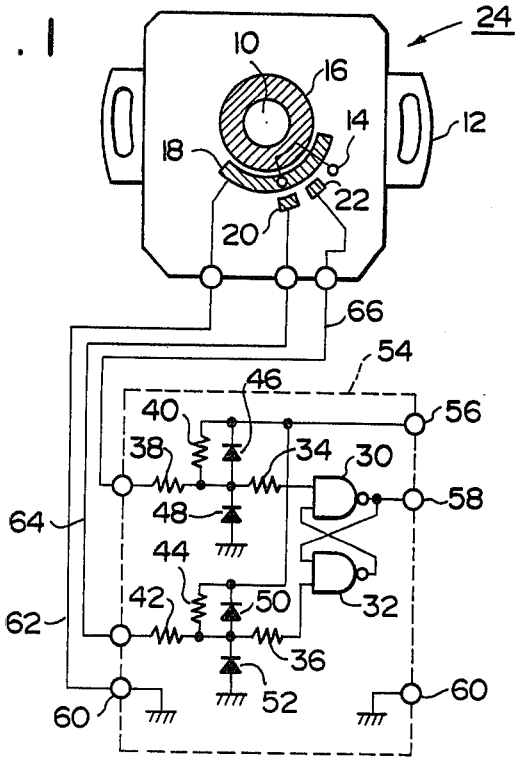
FIG. 1 is a circuit diagram showing the arrangement of one embodiment of the acceleration signal detector according to the present invention.

A detailed description will hereafter be given of one embodiment of the present invention with reference to the drawings. As shown in FIG. 1, the present embodiment comprises a throttle opening detector 24, including a base 12 disposed at one side surface of a throttle body with a throttle shaft 10 projecting therefrom. A rotor 16 is solidly secured to the throttle shaft 10 and provided therearound with a movable contact 14. A common contact plate 18 is fixed on said base 12, and disposed in a partial annular shape surrounding the throttle shaft 10 and being maintained in constant sliding contact with one terminal of the movable contact 14. A sector-like contact plate 20 for detecting the fully closed condition of the throttle valve is disposed also in a partial, annular shape outside of the common contact plate 18 and comes into sliding contact with the other terminal of the movable contact 14 when the throttle valve is in the fully closed condition. A sector-like contact plate 22 for detecting the half closed condition of the throttle valve is disposed on the same circumference as the contact plate 20 for detecting the fully closed condition of the throttle, and comes into sliding contact with the other terminal of the movable contact 14 at the position where the throttle shaft is opened through about 3 degrees from the fully closed condition. The sector-like contact plate 22 is disposed also in a partial, annular shape. A signal processing circuit 54 is provided, including NAND gates 30, 32 forming a flip-flop circuit, resistors 34, 36 for restricting current signals respectively fed from the contact plate 22 for detecting the half closed condition of the throttle valve or the contact plate 20 for detecting the fully closed condition of the throttle valve in said throttle opening detector 24. Resistors 38, 40 and 42, 44 are provided for voltage dividing to obtain the proper input voltage levels respectively for the NAND gates 30, 32, and diodes 46, 48 and 50, 52 are provided for restricting the input voltages fed to NAND gates 30, 32, respectively, to protect them. In the drawing, designated at 56 is a terminal connected to the power source of a signal processing circuit 54, terminal 58 is an output terminal connected to the output side of said NAND gate 30, and 60 is a grounding terminal. In addition, the throttle opening detector 24 and the signal processing circuit 54 are connected to each other in such a manner that the common contact plate 18 is connected to the grounding terminal of the signal processing circuit 54 through a lead wire 62. The contact plate 20 for detecting the fully closed condition of the throttle valve is connected to one end of the resistor 42 of the signal processing circuit 54 through a lead wire 64, and the contact plate 22 for detecting the half closed condition of the throttle valve is connected to one end of the resistor 38 of the signal processing circuit 54 through a lead wire 66.

Furthermore, the contact plate 20 for detecting the fully closed condition of the throttle valve is adapted to detect the fully closed condition of the throttle valve including a range from the mechanically fully closed condition of the throttle shaft to the position of the throttle shaft after it is rotated for several degrees. The reason for this is to obviate such a disadvantage that, in the case the contacts are set to come into contact only at the mechanically fully closed position of the throttle valve, if the throttle shaft fails to rotate to the mechanically fully closed position of the throttle valve due to the variation with time and the like, a signal for the fully closed condition of the throttle valve will not be obtained.

Operation of the apparatus of FIG. 1 is as follows. First, in case the throttle shaft 10 is fully rotated in the clockwise direction and the throttle valve is fully closed, the movable contact 14 is in contact with the contact plate 20 for detecting the fully closed condition of the throttle vale. Consequently, the resistor 42 of the signal processing circuit 54 is at ground through the contact plate 20 for detecting the fully closed condition of the throttle valve, the movable contact 14 and the common contact plate 18. The resistance value of the resistor 42 is made suitably small as compared with the resistance value of the resistor 44, with the result that "0" signal is given to one of input terminals of NAND gate 32 through the resistor 36. In contrast with this, at this time, the contact plate 22 for detecting the half closed condition of the throttle valve is not grounded, with the result that a "1" signal is given to NAND gate 30 through the resistors 40 and 34. Here, NAND gates 30, 32 form a well known flip-flop circuit, with the result that a "0" signal is sent out through the output terminal 58.

Next, in the case where the opening of the throttle valve becomes large and the throttle shaft 10 is rotated to some extent in the counterclockwise direction, the contact between the contact plate 20 for detecting the fully closed condition of the throttle valve and the movable contact 14 is cut off. A "1" signal is given to one of the input terminals of NAND gate 32 through the resistors 44, 36. Further, the throttle valve is opened, and the contact plate 22 for detecting the half closed condition of the throttle valve and the movable contact 14 comes into contact with each other with the resistor 38 being grounded. The relationship between the resistance values of the resistors 38 and 40 is made identical with the relationship between the resistance values of the resistors 42 and 44, with the result that a "0" signal is given to one of the input terminals of NAND gate 30. Accordingly, the output sent out of NAND gate 30 becomes "1" , and the output terminal 58 sends out a "1" signal. The change in output of the signal processing circuit 54 from "0" to "1" is detected as the time of acceleration to control the electrically controlled fuel injection system and the like. In this case, even if chattering of the contact takes place, the initial "0" signal reverse the flip-flop circuit and the reversed condition is maintained. Hence, the chattering of the contact does not cause any malfunction, the signal is not delayingly processed but is detected as the acceleration so that increased fuel rate during acceleration, accelerated fuel injection and the like can be effected.

Additionally, in the case where the throttle shaft 10 is further rotated in the counterclockwise direction and both the contact plate 20 for detecting the fully closed condition of the throttle valve and the contact plate 22 for detecting the half closed condition of the throttle valve do not come into contact with the movable contact 14, an output from NAND gate 30 is maintained at "1" and an output from NAND gate 32 at "0".

Next, in the case of the rotation of deceleration, as long as the signal sent out of the contact plate 20 for detecting the half closed condition of the throttle valve is maintained at a "1" level regardless of the output from the contact plate 22 for detecting the half closed condition of the throttle valve, then NAND gate 30 is maintained at the "1" level. When the movable contact 14 is rotated in the clockwise direction and comes into contact with the contact plate 20 for detecting the fully closed condition of the throttle valve, an output fed to one of the input terminals of NAND gate 32 becomes a "0" level and the output from NAND gate 32 is changed to a "1" level. Then, an output fed to one of the input terminals of NAND gate 30 at this time has already been changed to a "1" level, and hence, NAND gate 30 is reversed in its condition to return to the condition where it sends out a "0" signal.

Figure 2:
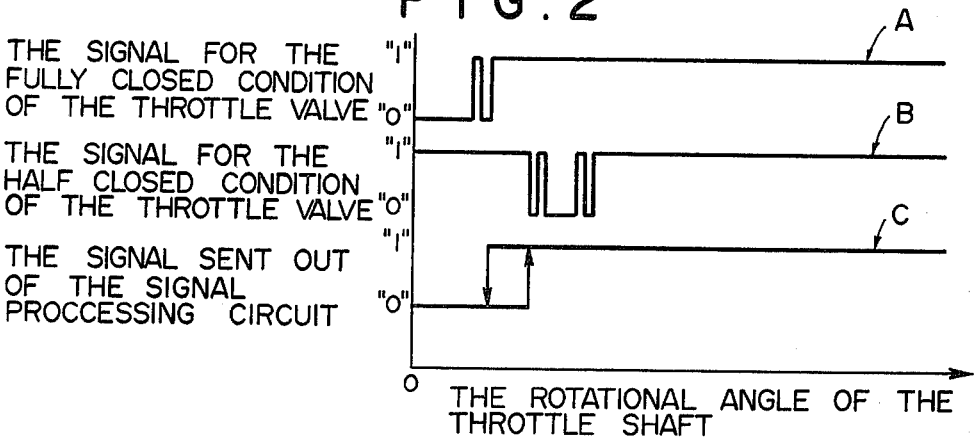
FIG. 2 is a diagram showing the relationship between the rotational angle of the throttle shaft and the signal for the fully closed condition of the throttle valve (A), the signal for the half closed condition of the throttle valve (B) and the signal sent out of the signal processing circuit (C) in the above-described embodiment.

FIG. 2 shows the relationship between the rotational angle of the throttle shaft and the signal for the fully closed condition of the throttle valve (a solid line A), the signal for the half closed condition of the throttle valve (a solid line B) and the signal sent out of the signal processing circuit (a solid line C) in the present embodiment. The signal A for the fully closed condition of the throttle valve indicates that an input signal fed to NAND gate 32 becomes "0" when the contact plate 20 for fully closed condition of the throttle valve is in contact with the movable contact 14, and the input signal fed to NAND gate 32 becomes "1" when the contact plate 20 is cut off from the movable contact 14. As apparent from the drawing, even if both the signal A for the fully closed condition of the throttle valve and the signal B for the half closed condition of the throttle valve cause the chattering phenomenon at the mechanical contacts when the condition is changed, the signal C sent out of the signal processing circuit is not subjected to the effect of this chattering and mistaken detection of the condition of acceleration at the time of deceleration can be eliminated. Furthermore, since the need for delaying the signal is eliminated, such excellent advantages can be attained that the responsiveness during acceleration is improved.

According to experiments conducted by the present inventors, the period of time required for an operator to depress the accelerator pedal for changing the throttle valve from a fully closed condition into a fully open condition is 100 to 150 milliseconds at the quickest, and 1 to 2 sec in general. Hence, the retardation in detecting of acceleration in the case the contact for detecting the fully open condition of the throttle valve is positioned through about 3 degrees from the fully closed condition toward the opening is 3.3 to 5 milliseconds during abrupt acceleration and 33 to 67 milliseconds during moderate acceleration. Thus it should be clear that the responsiveness is significantly improved as compared with the conventional retardation of signal (about 500 milliseconds).

Furthermore, in the above-described embodiment, the contact plate for detecting the half closed condition of the throttle valve is disposed at the position where the throttle valve is opened through about 3 degrees from the working angle of the contact plate 20 for detecting the fully closed condition of the throttle valve toward the opening of the throttle valve. However, the position where the contact plate for detecting the half closed condition of the throttle valve is disposed is not limited to the position described above, and any angle within 6 degrees may be selected, for example.

Additionally, in the above-described embodiment, both means for detecting the fully closed condition and the half closed condition are the sector-like fixed contacts which are disposed around the throttle shaft of the throttle valve and brought into contact with the movable contact which is rotatable with the throttle shaft, but both means are not limited to the above-described embodiment.

Further, in the above-described embodiment, the signal processing circuit is formed of a flip-flop circuit using two NAND gates, but the arrangement of the signal processing circuit is not limited to this.

Figure 3:
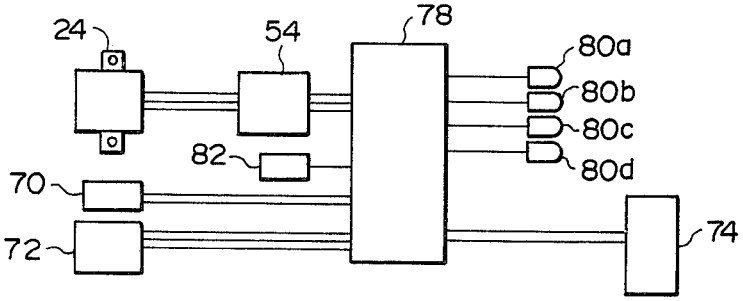
FIG. 3 is a block diagram showing an example wherein the above-described embodiment is applied to the electronically controlled fuel injection system of an automotive engine.

FIG. 3 shows an example of the construction of an electronically controlled fuel injection system of an automotive engine to which the above-described embodiment is applied. In the drawing, 70 designates an engine cooling water temperature sensor provided on an engine cylinder block or the like, 72 an intake air flow rate sensor provided in an intake air system, 82 an engine rotational speed sensor, 74 a battery feeding power to various components, and 78 an operation circuit for calculating the fuel injection times for fuel injection valves 80*a*, 80*b*, 80*c* and 80*d* provided on the respective cylinders based on the outputs from the signal processing circuit 54, engine cooling water temperature sensor 70, intake air flow rate sensor 72 and the like.

In the electronically controlled fuel injection system as described above, the basic injection times are calculated based on the output from the intake air flow rate sensor 72, the signal from the engine rotational speed sensor 82 and the like. The fuel injection times are corrected in accordance with the outputs from the engine cooling water temperature sensor 70, and the signal processing circuit 54 and the like, whereby fuel is injected through the fuel injection valves 80*a*, 80*b*, 80*c* and 80*d* in synchronism with the rotation of the engine, thereby effecting the air-fuel ratio control. Particularly, in the case where the output from the output terminal 58 of the signal processing circuit 54 is reversed from "0" to "1", the reverse is detected as the condition of acceleration to effect increased fuel flow rate during acceleration and accelerated fuel injection.

Although the present invention has been described with respect to certain specific embodiments, it should be clear that various modifications are possible without departing from the true spirit and scope of the invention.

What is claimed is:

1. An acceleration signal detector for detecting an acceleration signal of an engine based on the open-and-close action of a throttle valve, comprising:

first means for detecting the fully closed condition of the throttle valve to send out an output, wherein said first means is adapted to detect the range from the mechanically fully closed condition of the throttle shaft to the position of the throttle shaft after it is rotated for several degrees, second means for detecting the half closed condition of the throttle valve to send out an output, and signal processing means for detecting an acceleration from a change in the output of said second means subsequent to a change in the output of said first means.

2. An acceleration signal detector for detecting an acceleration signal of an engine based on the open-and-close action of a throttle valve, comprising:

first means for detecting the fully closed condition of the throttle valve to send out an output, second means for detecting the half closed condition of the throttle valve to send out an output, and signal processing means for detecting an acceleration from a change in the output of said second means subsequent to a change in the output of said first means, wherein said signal processing means is formed of a flip-flop circuit using two NAND gates.

* * * * *